US008414351B2

(12) United States Patent
Garbos et al.

(10) Patent No.: US 8,414,351 B2
(45) **Date of Patent: *Apr. 9, 2013**

(54) METHOD OF INTEGRATING OPTICAL FIBERS INTO FABRICS AND PLUSH TOYS

(75) Inventors: Jennifer R. Garbos, Kansas City, MO (US); Nancy Lynn Short, Roeland Park, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 11 days.

This patent is subject to a terminal disclaimer.

(21) Appl. No.: 13/165,607

(22) Filed: Jun. 21, 2011

(65) Prior Publication Data

US 2011/0261581 A1 Oct. 27, 2011

Related U.S. Application Data

(63) Continuation of application No. 11/868,030, filed on Oct. 5, 2007, now Pat. No. 7,988,525.

(51) Int. Cl.
*A63H 33/26* (2006.01)
*A63H 33/22* (2006.01)

(52) U.S. Cl. ..... 446/485; 446/219; 362/554; 362/559

(58) Field of Classification Search ..... 446/369, 446/485, 219; 362/555, 565, 566, 249.09; 40/547

See application file for complete search history.

(56) References Cited

U.S. PATENT DOCUMENTS

| | | | |
|---|---|---|---|
| 4,521,205 | A | 6/1985 | Spector |
| 4,754,372 | A | 6/1988 | Harrison |
| 4,828,527 | A | 5/1989 | Spector |
| 4,875,144 | A | 10/1989 | Wainwright |
| 4,998,186 | A | 3/1991 | Cocca |
| 5,277,644 | A | 1/1994 | Osborne et al. |
| 5,738,753 | A | 4/1998 | Schwar |
| 5,761,837 | A | 6/1998 | Tryon |
| 5,791,965 | A | 8/1998 | Kim |
| 5,881,206 | A | 3/1999 | Schwar |
| 5,944,416 | A | 8/1999 | Marsh |
| 6,151,439 | A | 11/2000 | Wainwright |
| 6,217,188 | B1 | 4/2001 | Wainwright et al. |
| 6,302,570 | B1 | 10/2001 | Petell |
| 6,382,825 | B1 | 5/2002 | Wainwright |
| 6,413,341 | B1 | 7/2002 | Wainwright |
| 6,537,130 | B1 | 3/2003 | Lee et al. |
| 6,651,365 | B1 | 11/2003 | Wainwright |
| 7,073,932 | B2 | 7/2006 | Wainwright |
| 7,232,251 | B2 | 6/2007 | Chien |
| 7,427,153 | B1 | 9/2008 | Jacobs |
| 2005/0018450 | A1 | 1/2005 | Chien |
| 2005/0057942 | A1 | 3/2005 | Mako et al. |
| 2005/0057943 | A1 | 3/2005 | Mako et al. |
| 2005/0223464 | A1 | 10/2005 | Huang et al. |
| 2005/0250412 | A1 | 11/2005 | Yang |
| 2006/0164856 | A1 | 7/2006 | Wang |

*Primary Examiner* — Gene Kim

*Assistant Examiner* — Urszula M Cegielnik

(74) *Attorney, Agent, or Firm* — Shook, Hardy & Bacon L.L.P.

(57) ABSTRACT

A method for incorporating optical fibers into sheet materials, such as fabrics, creates a structure which can be incorporated into items such as plush toys. Optical fibers are made to pass through the sheet material in a desired arrangements. Ends of the optical fibers are enlarged such that they will not readily pass back through the fabric. The ends are then covered with material that permits light to pass therethrough. The resulting structure can be readily incorporated into an item, such as a plush toy.

19 Claims, 3 Drawing Sheets

METHOD OF INTEGRATING OPTICAL FIBERS INTO FABRICS AND PLUSH TOYS

CROSS-REFERENCE TO RELATED APPLICATIONS

The present application is a continuation of pending U.S. application Ser. No. 11/868,030, entitled "METHOD OF INTEGRATING OPTICAL FIBERS INTO FABRICS AND PLUSH TOYS", filed Oct. 5, 2007.

STATEMENT REGARDING FEDERALLY SPONSORED RESEARCH OR DEVELOPMENT

Not applicable.

BRIEF SUMMARY OF THE INVENTION

The present invention relates to fiber optics. More particularly, this invention relates to a method of integrating optical fibers into fabrics and sheet materials, the resulting structure of which can be incorporated into an item (e.g., a plush toy).

To integrate the optical fibers, they are made to pass through a sheet material, such as a fabric, in a desired arrangement. Ends of the optical fibers are flattened and enlarged such that they will not readily pass back through the sheet material. The ends are then covered with another sheet material that permits light to pass therethrough. The two sheet materials are secured together to hold the enlarged ends there between. The resulting structure can be readily incorporated into an item, such as a plush toy, to provide a light option to the item.

Further objects, features and advantages of the present invention over the prior art will become apparent from the detailed description of the drawings which follows, when considered with the attached figures.

BRIEF DESCRIPTION OF THE SEVERAL VIEWS OF THE DRAWINGS

The features of the invention noted above are explained in more detail with reference to the embodiment illustrated in the attached drawing figures, in which like reference numerals denote like elements, in which FIGS. 1-5 illustrate one possible embodiment of the present invention, and in which:

FIG. 1 is a perspective view of a plush toy having a portion thereof made in accordance with the present invention;

FIG. 2 is an enlarged, fragmentary, perspective view of the plush toy of FIG. 1, wherein the plush toy has been activated to display light via fiber optics;

FIG. 3 is the same view as FIG. 2, but with a portion of an outer fabric of the hat cut-away to reveal some of the structure of the present invention;

FIG. 4 is a top perspective view of the of the plush toy of FIG. 1 with a portion of the top of the hat cut-away and a covering layer pulled up to reveal some of the structure of the present invention; and FIG. 5 is a fragmentary, cross-sectional view of the hat taken along the line 5-5 of FIG. 2 to further illustrate one possible structure of the present invention created by a method of the present invention.

DETAILED DESCRIPTION OF THE INVENTION

Figure 1:
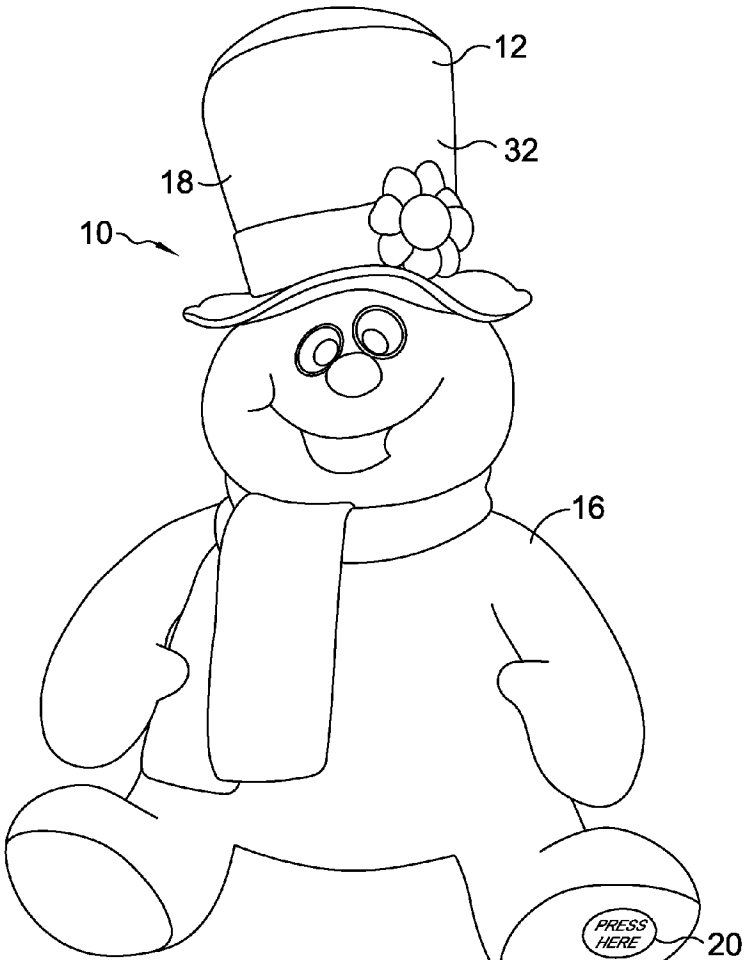

Referring now to the drawings in more detail and initially to FIG. 1, numeral 10 generally designates a plush toy having a portion thereof constructed in accordance with a method of the present invention. The plush toy 10 includes a body portion 12 that is generally filled with stuffing, batting or fill 14, as is readily known in the art. In the illustrated embodiment, the body portion 12 includes a character portion 16 and a hat portion 18. Received inside the body portion 12, in addition to stuffing 14, are electrical components for providing the plush toy 10 with an audiovisual feature. The electrical components, to maximize the softness of the plush toy 10 and decrease the possibility of interaction therewith by a user, such as a child, may be buried inside the fill 14 of the plush toy 10. The electrical components may include a speaker (not shown), a sound module (not shown) for storing and playing audio sounds, a battery (not shown) and a plurality of wires (not shown) for distributing electrical current through the plush toy 10 to operate the electrical components. A switch (not shown) may also be provided and maybe concealed within the plush toy for activating the audiovisual feature. A button location indicator 20 may be provided to indicate to the user the location of the concealed switch. Other switches, both concealed and not concealed, are within the scope of knowledge of one of ordinary skill in the art.

The electrical components may also include a light source (not shown, such as an LED or other suitable light source) for selectively providing light to a light display 22. The light source may be coupled with proximal ends 24 of a plurality of optical fibers 26 via a coupler 28. The coupler 28 can hold the proximal ends 24 of the optical fibers 26 together in a bundle, thereby allowing a single light source to provide light to the plurality of optical fibers 26.

As is understood in the art, the optical fibers 26 carry light therethrough from the light source to distal ends 30 of the optical fiber 26 whereupon the light exits the distal end 30 of the optical fibers 26 and is visible to a user. The distal ends 30 of the optical fibers 26 may be spaced apart to create a desired visual pattern in the resulting light display 22.

In accordance with an aspect of the present invention, and to both obstruct the distal ends 30 of the optical fibers 26 from view when the light display 22 is not active and to prevent contact with the distal ends 30 of the optical fibers 26 by a user, the light display 22 is covered with an outer most fabric 32. Though not required, the outer most fabric 32 is preferably soft to the touch. As such, it is generally formed of a cloth, fabric or other textile. However, the outer most fabric 32 can be any thin material suitable for covering the light display 22. Preferably, the outer most fabric should be both capable of permitting light from the optical fibers 26 to pass therethrough during operation as well as being sufficiently opaque such that the distal ends 30 of the optical fibers 26 are not readily visible when the light display 22 is not activated.

The light display 22 may be formed as an assembly 34 that is separate from the plush toy 10, but which may be readily incorporated therein. The assembly 34 includes a first sheet 36 through which the optical fibers 26 are made to pass. The optical fibers 26 create small apertures 38 through the first sheet 36 as they pass therethrough. The apertures 38 are slightly larger than the distance around the optical fibers 26. Further, depending on the material that is used for the first sheet 36, the apertures 38 could provide a friction fit with regard to the optical fibers 26 passing therethrough. This would especially be the case if the first sheet 36 was a flexible foam sheet. It should be noted that the first sheet 26 can be any material suitable for carrying the optical fibers 26. Possible materials include fabrics, flexible foam sheets, textiles, papers, polymeric sheets, polymeric films, plastic sheets, plastic films, foils and any other thin sheet of material.

The assembly 34 also preferably includes a cover sheet 40 for covering the distal ends 30 of the optical fibers 26. While the cover sheet 40 could be the outer most fabric 32, the cover sheet 40, as illustrated the embodiment of FIG. 5, may also be a separate sheet. The embodiment where the cover sheet 40 is a separate sheet can facilitate the construction of the assembly 34 separate from the construction of the plush toy 10. The cover sheet 40 should be of a material that permits light to pass therethrough. In the illustrated embodiment, the cover sheet 40 is a transparent film and, more particularly, is a transparent tape having adhesive on an inner surface 42 such that the cover sheet 40 adheres to the distal ends 30 of the optical fibers 26 as well as to an outer surface 44 of the first sheet 36. While the illustrated embodiment discloses the cover sheet 40 as a tape having adhesive thereon, the cover sheet 40 could be coupled with the first sheet 36 by other known means, such as by stitching. The cover sheet 40, when coupled with the first sheet 36, positions the distal ends 30 of the optical fibers 26 between the first sheet 36 and the cover sheet 40 and prevents the distal ends 30 from moving to far away from the first sheet 36.

To keep the distal ends 30 from withdrawing through the apertures 38 in the first sheet 36, the distal ends 30 are preferably enlarged such that they have an outer periphery greater than a distance around the interior of the apertures 38. In an embodiment where the optical fibers 26 and the distal ends 30 both have circular cross sections, the outer diameter of the distal ends 30 are greater than the inner diameter of the apertures 38. The enlarged distal ends 30, being larger than the apertures 38, prevent the distal ends 30 from passing through the first sheet 36 back into the interior of the body portion 12 of the plush toy 10. The distal ends 30 of the optical fibers 26 can be enlarged by a number of different methods. One method is to heat the end of the optical fibers. Another method is to place a separate item on the end of the optical fiber. The item is coupled with the end of the optical fibers 26 and permits light to pass therethrough. While it is contemplated that the distal ends 30 of the optical fiber 26 will be enlarged after the optical fibers 26 are passed through the first sheet 36, it is within the scope of the present invention to provide optical fibers 26 that already have enlarged distal ends 30 and subsequently insert the proximal ends 24 through the first sheet 36 until the distal end 30 abut the outer surface 44 of the first sheet 36.

In one embodiment, the assembly 34 also includes an inner sheet 46 that covers a portion of the optical fibers 26 as they exit the apertures 38 on a side opposite the distal ends 30. In one embodiment, the inner sheet 46 may take the form of a tape having an adhesive on an inner surface 48 thereof. In this embodiment, the inner sheet 46 would be adhered to the optical fibers 26 and an inner surface 50 of the first sheet 36 to help fix the relationship of the optical fibers 26 with respect to the apertures 38. While the inner sheet 46 may be transparent, it is preferably either opaque or translucent. As with the cover sheet 40, the inner sheet 46 need not be adhered to the first sheet 36 but can be coupled therewith by other known means, such as by sewing.

Figure 2:
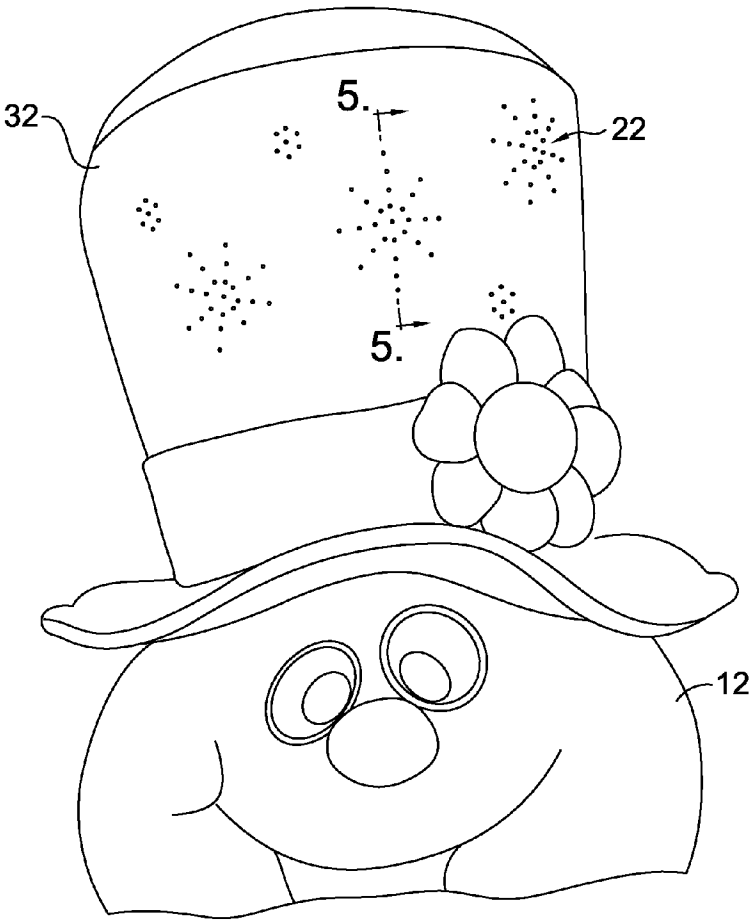

FIG. 1 illustrates a plush toy 10 having a light display 22 assembled in accordance with the present invention incorporated therein. The light display 22 is not visible when the plush toy is in its normal rest state. When not activated, the outermost fabric 32 hides the light display 22 and the distal ends 30 of the optical fibers 26 from view. FIG. 2 illustrates the plush toy at a time when the light display 22 has been activated by the user. Light from the light source contained within the body portion 12 is passed through the optical fibers 26 within the body portion 12 and directed by the optical fibers 26 to shine through the outermost fabric 32 to create a visibly pleasing display of light emitted from the plush toy 10.

Figure 3:
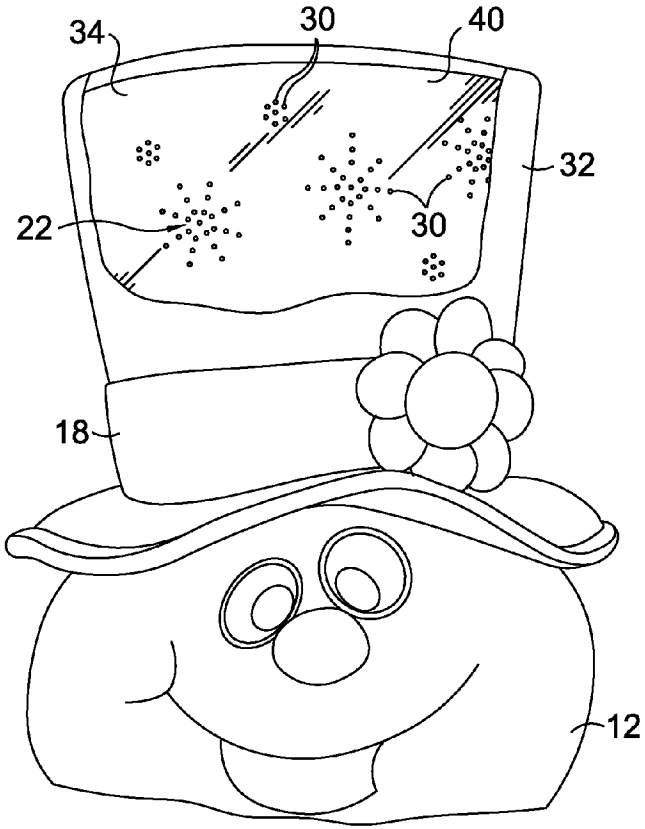

FIG. 3 has a portion of the outermost fabric removed to reveal the assembly 34 from a front side where the cover sheet 40 is visible along with the distal ends 30 of the optical fibers 26 through the cover sheet 40.

Figure 4:
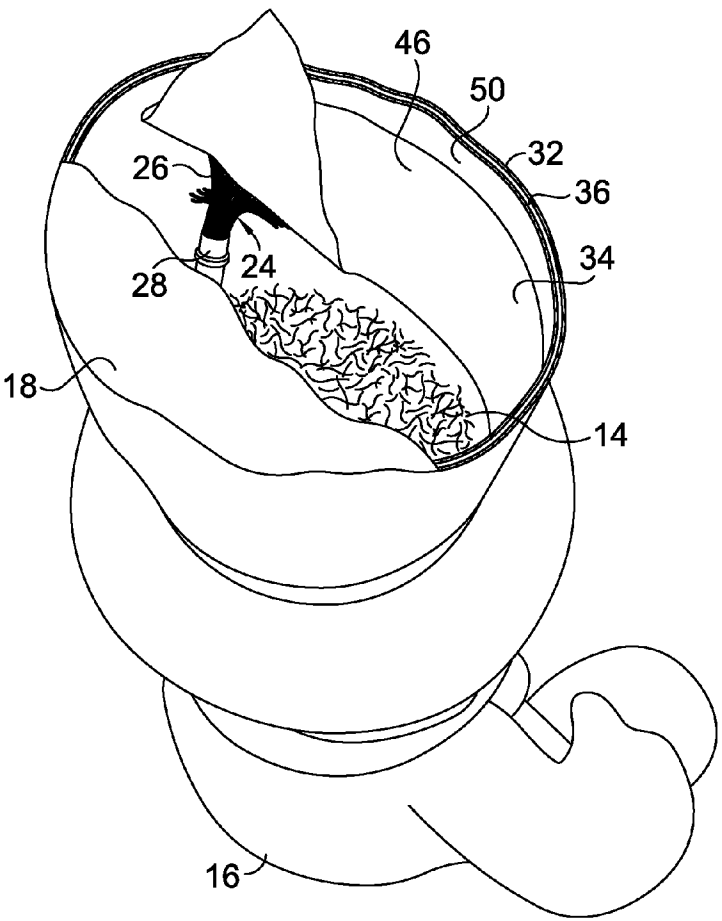

FIG. 4 illustrates the interior of the hat portion 18 and the incorporation of the assembly 34 into the plush toy 10. A portion of the inner sheet 46 has been lifted up to reveal the proximal ends 24 of the optical fibers 26 and the coupler 38. Additionally, some of the batting 14 has been removed from the body portion 12 to permit viewing of the assembly 34.

Figure 5:
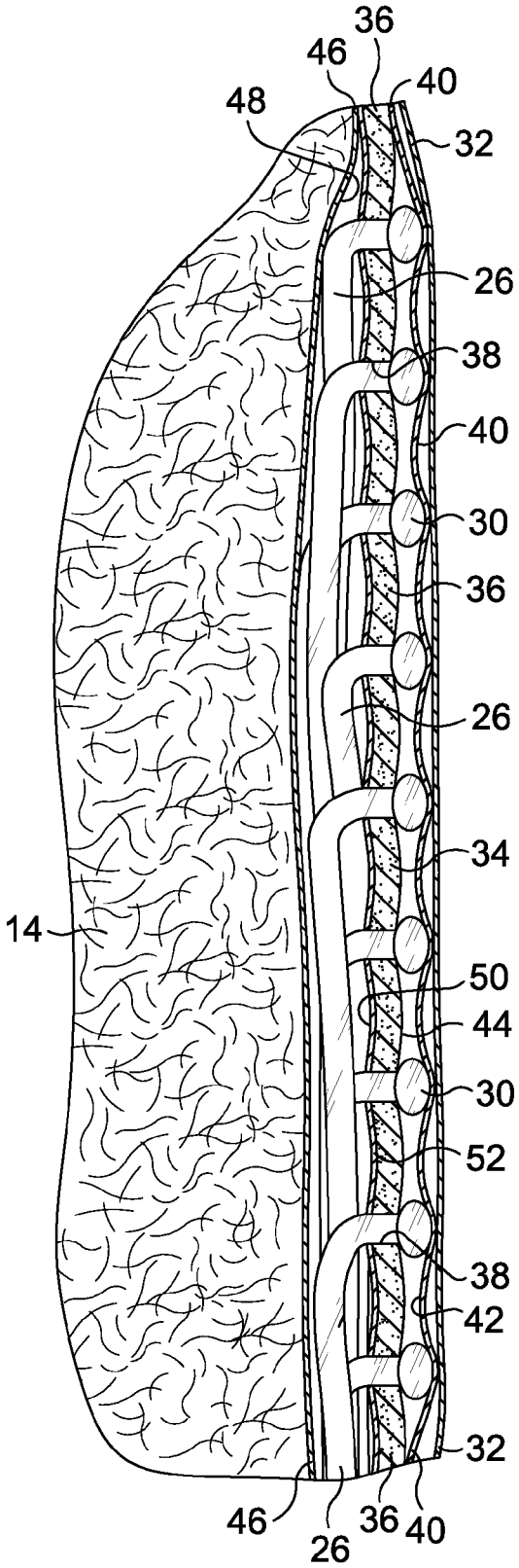

FIG. 5 illustrates a cross section of the light display 22 and the assembly 34 integrated into the plush toy 10. In the particular embodiment illustrated, the first sheet 36 is compromised of a flexible foam sheet and further includes a paper backing 52 adhered to the inner surface 50 of the first sheet 36.

Many variations can be made to the illustrated embodiment of the present invention without departing from the scope of the present invention. Such modifications are within the scope of the present invention. For example, the cover sheet 40 could be eliminated and the first sheet 36 could be attached directly to the outermost fabric 32. Similarly, the inner sheet 46 could be eliminated and the optical fibers could be exposed to contact with the batting 14. However, it has been found beneficial for manufacturing and assembly purposes to create the assembly 34 consisting of tape 40 and 46 on opposite sides of the first sheet 36 to secure the optical fibers in relation to the first sheet 36. The pre-assembled assembly 34 can then be readily incorporated into a plush toy 10. Other modifications would be within the scope of the present invention.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A structure for displaying light, the structure comprising:

a first sheet material;

a plurality of optical fibers passing through the sheet material and having proximal and distal ends, wherein the proximal ends of multiple optical fibers are bundled together to receive light from a source, wherein the distal ends have an outer periphery greater than an outer periphery of the optical fibers, and wherein the proximal and distal ends of the optical fibers are on opposite sides of the sheet material; and an outer covering material that permits light to pass therethrough, wherein the outer covering is positioned adjacent the distal ends of the optical fibers and wherein the distal ends of the optical fibers are intermediate the sheet material and the outer covering material.

2. The structure of claim 1, wherein the first sheet material is selected from a group including: fabrics, flexible foam sheets, textiles, papers, polymeric sheets, polymeric films, plastic sheets, plastic films, and foils.

3. The structure of claim 1, wherein the outer covering is coupled with the first sheet material, whereby the distal ends of the optical fibers are sandwiched therebetween.

4. The structure of claim 3, wherein the outer covering is a transparent tape having adhesive on a side thereof, wherein the outer covering is coupled with the first sheet material by the adhesive, and wherein at least some of the adhesive contacts the distal ends of the optical fibers.

5. The structure of claim 1, wherein the outer covering is coupled with the first sheet material and is transparent.

6. The structure of claim 1, wherein the outer covering is coupled with the first sheet material and is a transparent tape having adhesive on a side thereof, wherein the outer covering is coupled with the first sheet material by the adhesive, and wherein at least some of the adhesive contacts the distal ends of the optical fibers.

7. The structure of claim 1, further comprising an inner covering material for covering a portion of the optical fiber on an opposite side of the sheet material from the distal end.

8. The structure of claim 7, wherein the inner covering material is a tape having an adhesive on a first surface thereof, wherein adhesive of the tape is placed into contact with the covered portion of the optical fiber and the sheet material.

9. The structure of claim 8, wherein the first sheet material is selected from a group including: fabrics, flexible foam sheets, textiles, papers, polymeric sheets, polymeric films, plastic sheets, plastic films, and foils.

10. The structure of claim 7, wherein the first sheet material is selected from a group including: fabrics, flexible foam sheets, textiles, papers, polymeric sheets, polymeric films, plastic sheets, plastic films, and foils.

11. The structure of claim 1, wherein the first sheet material is fabric.

12. The structure of claim 1, wherein the first sheet material is a flexible foam sheet.

13. The structure of claim 1, wherein the first sheet material is paper.

14. The structure of claim 1, wherein the first sheet material is a plastic sheet.

15. A structure for displaying light, the structure comprising:

a first sheet material;

one or more optical fibers passing through the sheet material and having proximal and distal ends, wherein the proximal ends are intended to receive light from a source adjacent the proximal ends, wherein the one or more optical fibers direct the light from the proximal ends, through first sheet material, and to and out the distal ends, wherein the distal ends terminate in an enlarged portion of an outer dimension greater than an outer dimension of the optical fiber where it passes through the first sheet material to keep the distal ends from passing through the first sheet material, and wherein the proximal and distal ends of the optical fibers are on opposite sides of the first sheet material; and an outer covering material that permits light to pass therethrough, wherein the outer covering is positioned adjacent the distal ends of the optical fibers, wherein the distal ends of the optical fibers are intermediate the sheet material and the outer covering material, and wherein the outer covering is coupled with the first sheet material.

16. The structure of claim 15, wherein the outer covering is a transparent tape having adhesive on a side thereof, wherein the outer covering is coupled with the first sheet material by the adhesive, and wherein at least some of the adhesive contacts the distal ends of the optical fibers.

17. The structure of claim 15, further comprising an inner covering material for covering a portion of the one or more optical fibers on an opposite side of the sheet material from the distal end and wherein the inner covering material is coupled with the first sheet material, wherein a portion of the one or more optical fibers are secured between the inner covering material and the first sheet material, and wherein the distal ends of the one or more optical fibers are secured between the first sheet material and the outer covering.

18. The structure of claim 17, wherein the inner covering material is a tape having an adhesive on a first surface thereof, wherein adhesive of the tape is placed into contact with the portion of the optical fiber on the opposite side of the sheet material from the distal end that is covered by the inner covering material and the sheet material.

19. The structure of claim 15, wherein the first sheet material is selected from a group including: fabrics, flexible foam sheets, textiles, papers, polymeric sheets, polymeric films, plastic sheets, plastic films, and foils.

* * * * *